US006568914B2

(12) United States Patent
Ahn

(10) Patent No.: US 6,568,914 B2
(45) Date of Patent: May 27, 2003

(54) COMPRESSOR WITH PULSATION PRESSURE REDUCING STRUCTURE

(75) Inventor: Hew Nam Ahn, Taejon-Si (KR)

(73) Assignee: Halla Climate Control Corp., Taejon-Si (KR)

( * ) Notice: Subject to any disclaimer, the term of this patent is extended or adjusted under 35 U.S.C. 154(b) by 7 days.

(21) Appl. No.: 09/886,535

(22) Filed: Jun. 20, 2001

(65) Prior Publication Data

US 2002/0197169 A1 Dec. 26, 2002

(51) Int. Cl.[7] ..... F04B 1/26
(52) U.S. Cl. ..... 417/222.2; 417/540
(58) Field of Search ..... 417/222.1, 222.2, 417/540, 269; 418/55.4, 55.5, 15; 62/133

(56) References Cited

U.S. PATENT DOCUMENTS 5,520,526 A * 5/1996 Fujio ..... 418/55.4
5,556,260 A * 9/1996 Takenaka et al. ..... 417/269
5,645,405 A * 7/1997 Ota et al. ..... 417/269
5,762,483 A * 6/1998 Lifson et al. ..... 418/55.5
5,855,475 A * 1/1999 Fujio et al. ..... 418/15
6,045,342 A * 4/2000 Kimura ..... 417/540
6,280,161 B1 * 8/2001 Seo ..... 417/540
6,434,956 B1 * 8/2002 Ota et al. ..... 62/133

* cited by examiner

*Primary Examiner*—Teresa Walberg
*Assistant Examiner*—Leonid Fastovsky
(74) *Attorney, Agent, or Firm*—Lowe Hauptman Gilman & Berner, LLP

(57) ABSTRACT

A swash plate type compressor used for the air conditioner of an automobile is presented. The compressor has a structure where pulsation pressure caused when refrigerants are compressed and discharged is reduced, thereby permitting noise at the time of driving to be substantially reduced. The compressor can embody the structure by distributing and discharging refrigerant that has been compressed by a plurality of pistons and discharged from a plurality of bores into at least two discharge holes, wherein a frequency of the pulsation pressure is increased in proportion to the number of the discharge holes, but the strength of the pulsation pressure is decreased in inverse proportion to the number of discharge holes. Therefore, the driving noise of the compressor that is formed in proportion to the strength of the pulsation pressure is considerably decreased.

4 Claims, 5 Drawing Sheets

COMPRESSOR WITH PULSATION PRESSURE REDUCING STRUCTURE

BACKGROUND OF THE INVENTION

1. Field of the Invention

The present invention relates generally to a swash plate type compressor used for the air conditioner of an automobile, and more particularly to a compressor with a pulsation pressure reducing structure, which is capable of reducing the noise of the pulsation pressure of refrigerant discharge in the process of refrigerant being compressed and discharged, thereby allowing the compressor to have a low operating noise.

2. Background of the Related Art

Generally, a compressor constituting a principal element of the cooling system of the air conditioner of an automobile is an apparatus that selectively receives power from an engine through a pulley by the intermittent action of an electromagnetic clutch, compresses vapor refrigerants having exchanged heat in an evaporator into high-temperature and high-pressure refrigerant easy to be liquefied, and discharges the resulting refrigerant to a condenser.

Such a compressor may be generally classified into a reciprocating type or rotary type according to its refrigerant compressing manner and refrigerant compressing structure.

The swash plate type compressor belonging to the reciprocating compressor is constructed to suck, compress and discharge low pressure refrigerant having been evaporated in an evaporator, in such a manner that a disc-shaped swash plate slantly mounted around a driving shaft to which the power of the engine is applied is rotated by means of the driving shaft and a plurality of pistons coupled by means of a shoe with the periphery of the swash plate are rectilinearly reciprocated through a plurality of bores formed on a cylinder. According to piston pressurizing manners, such the swash plate compressor may be classified into a single head piston type in which pressurizing force is applied to only the one face of the piston or duplex head piston type in pressurizing force is applied to the both faces of the piston.

The present invention relates to the single head piston type compressor, and more particularly to a variable displacement swash plate type compressor in which the inclination angle of its swash plate is varied, thereby making it possible to vary the amount of the reciprocating movement of the piston, such that the amount of compression of the refrigerants can be adjusted in accordance with thermal load.

The variable displacement swash plate type compressor has the following advantages when compared with a fixed displacement swash plate type compressor: that is, the variable displacement swash plate type compressor has a reduced number of parts, so it is lightweight and its refrigerant compressing capacity can be controlled depending on thermal load, thereby effectively adjusting a room temperature and improving the driving performance of an automobile.

FIG. 5 illustrates an example of a conventional variable displacement swash plate type compressor, wherein the internal construction thereof is shown.

As depicted in the drawing, the conventional variable displacement swash plate type compressor includes: a cylinder block 101 provided with a plurality of cylinder bores 103 in a longitudinal direction through the interior thereof; a front housing 111 positioned in front of the cylinder block 101 to define a crank chamber 113 in the interior thereof; a rear housing 121 coupled to the rear side of the cylinder block 101 to define a suction chamber 123 and a discharge chamber 125 in the interior thereof; a plurality of pistons 131 adapted to be inserted into each of the plurality of cylinder bores 103 of the cylinder block 101 to be moved forward and rearward and provided on their rear ends with a plurality of bridges 133; a driving shaft 141 adapted to be inserted into the center of the cylinder block 101 through the front housing 111 and thus rotatably supported by the front housing 111 and the cylinder block 101; a lug plate 151 adapted to be fixedly attached to the driving shaft 141 in the interior of the crank chamber 113 and thereby rotated with the driving shaft 114; a swash plate 161 adapted to be fitted slantly to the driving shaft 141 in the crank chamber 113 in such a manner as to be adjusted in the inclination angle thereof, fitted through a shoe to a swash plate receiving groove of the bridge 133 on the rear end of each piston 131 on the outer periphery thereof and hinge-coupled rotatably to the lug plate 151 on the one side of the front surface thereof, thereby rotating with the lug plate 151; and a valve plate 173 provided with a plurality of suction holes 175*a* and a plurality of discharge holes 175*b* for the plurality of cylinder bores 103 of the cylinder block 101, between the cylinder block 101 and the rear housing 121 and disposed, with a suction reed valve 175 and a discharge reed valve 177 for opening and closing each of the suction holes 175*a* and discharge holes 175*b*, between the front and rear sides of the cylinder block 101 and the rear housing 121, such that each bore 103 of the cylinder block 101 can be closed relative to the suction chamber 123 and the discharge chamber 125 of the rear housing 121. A reference numeral 191 denotes a pressure control unit, which compares the pressure in the crank chamber 113 with the pressure in each bore 103 and controls the resulting pressure value, thereby varying the inclination angle of the swash plate 161.

The compressor constructed as described above compresses refrigerant and discharges it to a condenser (not shown) while all the elements of the compressor operate in cooperation with one another.

First, when the driving shaft 141 selectively receives the rotary force of the pulley (not shown), to which the driving force of an engine is transmitted, by the intermittent action of the electromagnetic clutch (not shown) through a disc and hub assembly (not shown) and rotates, the lug plate 151 fixedly attached around the driving shaft 141 rotates together with the driving shaft 141, resulting in the rotation of the swash plate 161 hinge-coupled to the lug plate 151. At this time, the swash plate 161 is swung in an axial direction on the outer periphery thereof due to the inclination angle relative to the driving shaft 141, such that each piston 131 engaged with the outer periphery of the swash plate 161 carries out a rectilinear reciprocating movement in an axial direction in each cylinder bore 103. During this process, positive pressure and negative pressure are alternately produced in each bore 103 so that the refrigerant are sucked, compressed and discharged.

The conventional swash plate type compressor compressing refrigerant through the aforementioned process compresses the refrigerant by the rectilinear reciprocating movement of the pistons performed periodically at predetermined intervals, such that the flow of refrigerant has pulsation pressure having the same period as the refrigerant discharge period of each piston 131 while the refrigerant is discharged from each cylinder bore 103 through the discharge chamber 125 and the discharge hole 129. As a result, the conventional swash plate type compressor is problematic in that a driving noise is caused by the pulsation pressure.

In order to solve the problem of the noise caused by the pulsation pressure, for example, in case of the duplex head piston type compressor where pressure is applied to the both faces of the piston, the pulsation pressure can be somewhat reduced in such a manner that the pulsation pressure of the compressed refrigerant discharged from the front housing is overlapped with the pulsation pressure of the compressed refrigerants discharged from the rear housing. However, in case of the single head piston type compressor where pressure is applied to only the one face of the piston, the single head piston type compressor cannot adopt the pulsation pressure reducing method of the duplex head piston compressor, in which two refrigerant flows discharged from two refrigerant discharge chambers are overlapped with each other, because the single head piston type compressor has only a single refrigerant discharge chamber 125 formed beside one side of the cylinder block, as shown in FIG. 5.

In order to remove the driving noise, there has been used a technique in which the conventional single head piston compressor is provided on one side of the outer circumferential surface of the cylinder block 103 or the rear housing 121 with a muffler 181 having a large volume that communicates with the discharge hole 129 of the rear housing 121 and a discharge pipe passage (not shown) connected to the discharge hole 129.

In this case, however, the provision of the muffler 181 on one side of the outer circumferential surface of the cylinder block 103 or the rear housing 121 causes the overall volume of the compressor to be substantially increased, such that the compressor is not compact. Moreover, the compressed refrigerant is forcibly delivered from the discharge chamber 125 through only the single passage coupled to the one discharge hole 129 and the discharge pipe passage (not shown), so a pulsation pressure reducing effect is not sufficient and, therefore, a driving noise is still great.

SUMMARY OF THE INVENTION

An object of the present invention is to provide a compressor with a pulsation pressure reducing structure where the pulsation pressure upon refrigerant discharge necessarily generated during refrigerants are compressed and discharged is reduced, even if it is a swash plate compressor using a single head piston; to provide such a compressor which does not need any increase in volume; and to provide such a compressor which is compact and makes substantially less driving noises.

In order to accomplish the above object, the present invention provides a compressor with a pulsation pressure reducing structure, comprising: a cylinder block provided with a plurality of bores radially arranged to be extended therethrough in forward and backward directions; a front housing positioned in front of the cylinder block to define a crank chamber that communicates with the bores of the cylinder block in the interior thereof; a rear housing coupled to the rear side of the cylinder block by disposing a plurality of suction and discharge reed valves for opening and closing a plurality of suction holes and discharge holes having the same number as that of the bores of the cylinder block on the front and rear sides of a valve plate, between the cylinder block and the rear housing, providing a suction chamber and a discharge chamber that communicate with the plurality of bores through the plurality of suction holes and the plurality of discharge holes in such a manner to be separated from each other, on the rear side of the cylinder block, and providing a suction pipe passage that communicates with the suction chamber and a discharge pipe passage that communicates with the discharge chamber through at least two discharge holes separated from each other relative to the plurality of discharge holes of the valve plate; a driving shaft adapted to be extended through the front housing in such a manner as to be disposed on the center of the crank chamber in a longitudinal direction of the cylinder block and supported by means of the front housing; a lug plate adapted to be fixedly attached around the driving shaft of the crank chamber and rotated by the driving shaft; a swash plate adapted to be slantly fitted around the driving shaft and hingedly attached to the lug plate to be rotated together by the lug plate; and a plurality of pistons adapted to be engaged with the outer periphery of the swash plate to perform reciprocating movement within the bores of the cylinder block by wobbling of an outer periphery of the swash plate in the forward and backward directions according to the rotation of the driving shaft.

The at least two discharge holes connecting the discharge chamber to the discharge pipe passage in the rear housing may be spaced apart from each other so that refrigerant flows, which are discharged from the discharge chamber through the at least two discharge holes to the discharge pipe passage while having a pulsation pressure of the same period, by an interval to allow the refrigerant flows to have a phase difference at a position where the two refrigerant flows meet.

The phase difference between pulsation pressures of two refrigerant flows may be a half of a period of the pulsation pressures.

The suction holes connecting the suction pipe passage to the suction chamber in the rear housing may be at least two in number, and spaced from an inlet of the suction pipe passage by different distances.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Reference will now be made in detail to the preferred embodiments of the present invention, examples of which are illustrated in the accompanying drawings.

Figure 1:
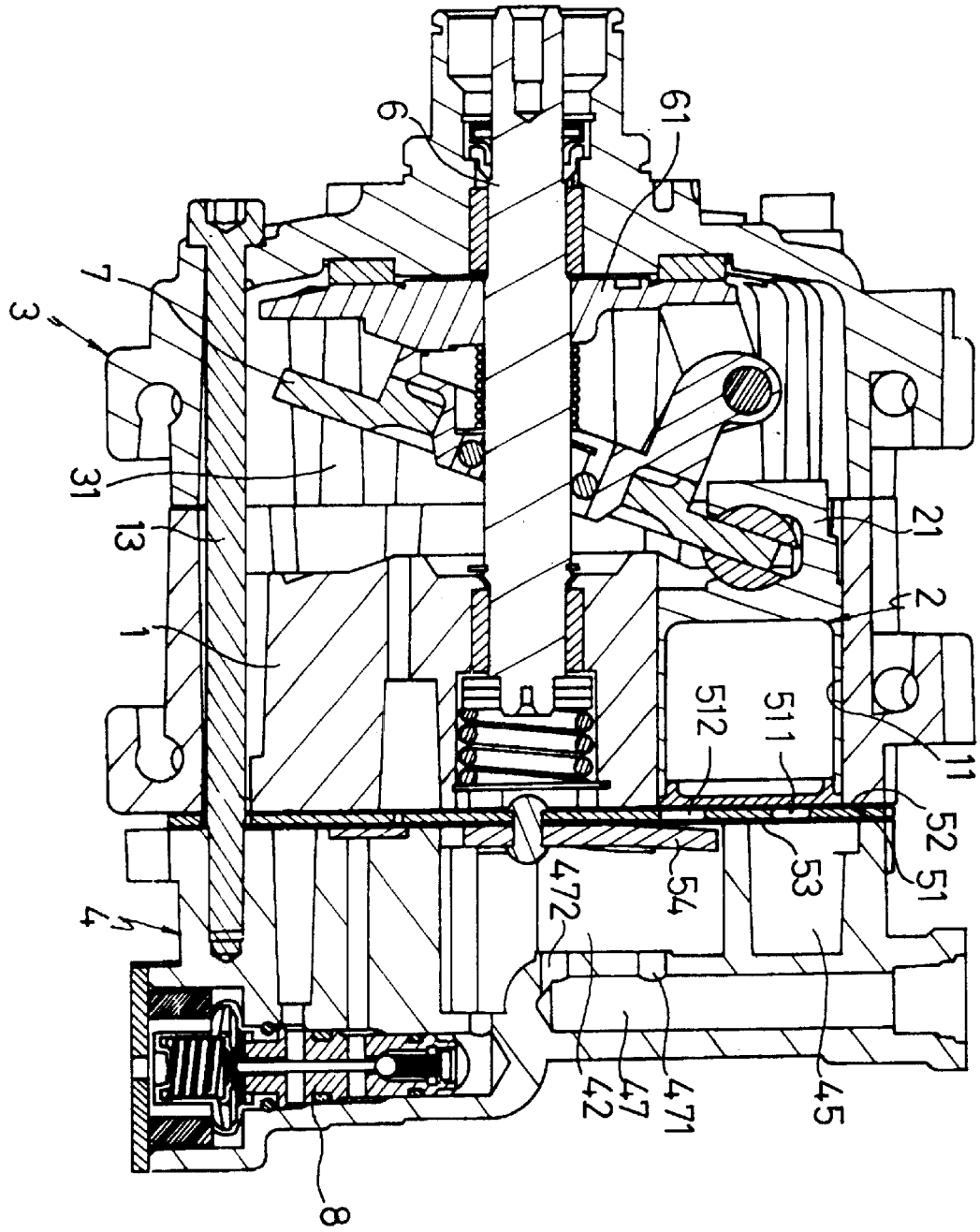
FIG. 1 is a sectional view showing the internal construction of a compressor with a pulsation pressure reducing structure in accordance with the present invention.

FIG. 1 illustrates a sectional view of the internal construction of a compressor with a pulsation pressure reducing structure in accordance with the present invention.

As shown in the drawing, the compressor with a pulsation pressure reducing structure in accordance with the present invention includes: a cylinder block 1; a front housing 3 coupled onto the front side of the cylinder block 1; a rear housing 4 coupled onto the rear side of the cylinder block 1; a valve plate 51 disposed between the cylinder block 1 and the rear housing 4; a driving shaft 6 adapted to be passed through the front housing 3 in such a manner as to be rotatably supported by the front housing 3; a swash plate 7 adapted to be slantly fitted around the driving shaft 6 while being hingedly attached at its one peripheral position to a lug plate 61 fixedly attached around the driving shaft 6; and a plurality of pistons 2 each adapted to be inserted into each bore 11 of the cylinder block 1 to be moved forward and backward.

In the above-described construction, the cylinder block 1 is generally made of aluminum, and provides a plurality of bores 11 wherein a plurality of pistons 2 carry out the reciprocating movement so as to suck and compress the refrigerants. The plurality of bores 2 are radially arranged at equal intervals in the cylinder block 1 in a circumferential direction thereof and pass through the cylinder block 1 in forward and backward directions to allow the plurality of pistons 2 to be inserted to perform reciprocating movement.

The front housing 3 is a die casting mold product, which is coupled to the front side of the cylinder block 1, and defines a crank chamber 31, which communicates with the bores 11 of the cylinder block 1 and is sealed from the outside, in front of the cylinder block 1.

Figure 2:
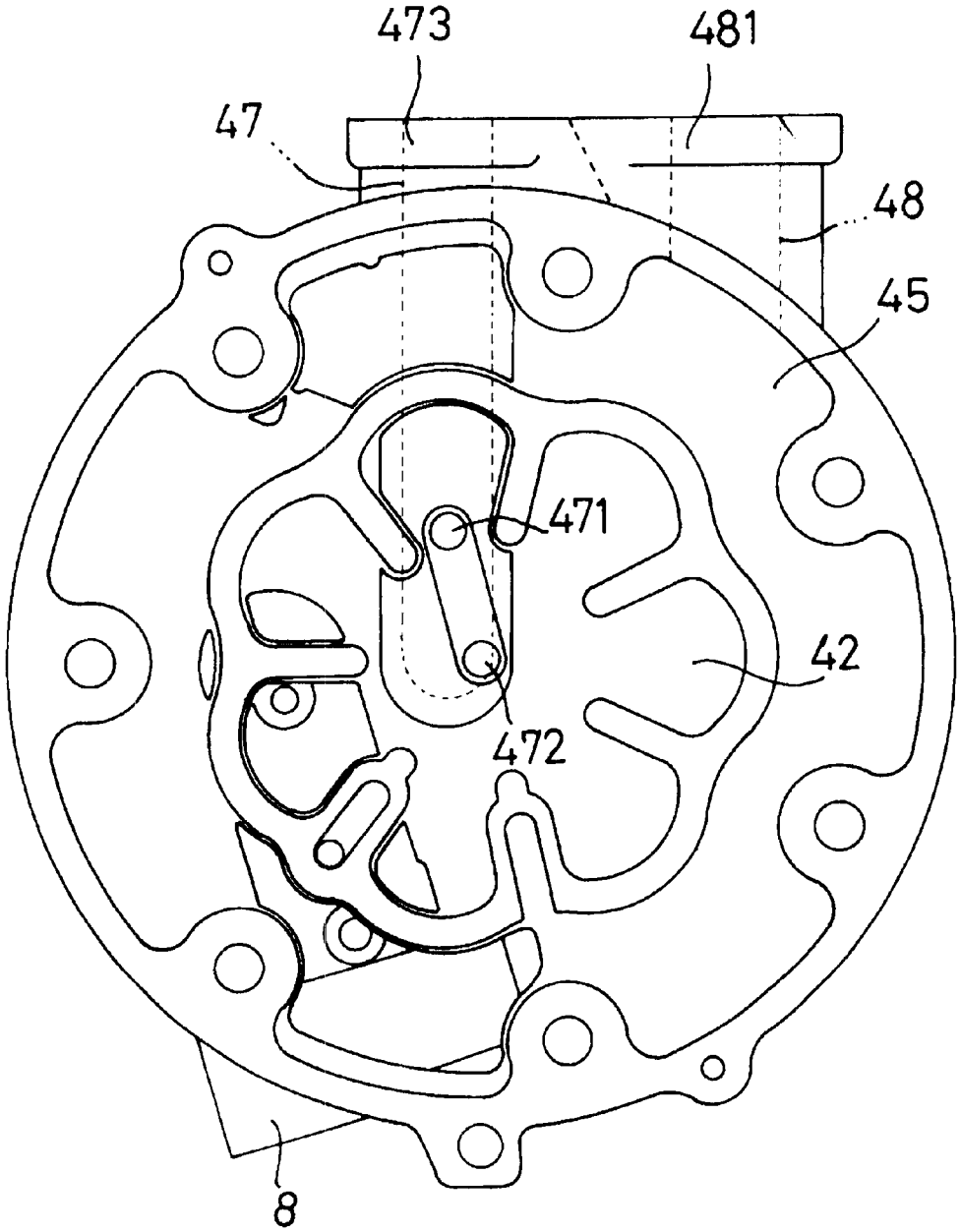
FIG. 2 is a front view showing the rear housing of the compressor of FIG. 1.
Figure 3:
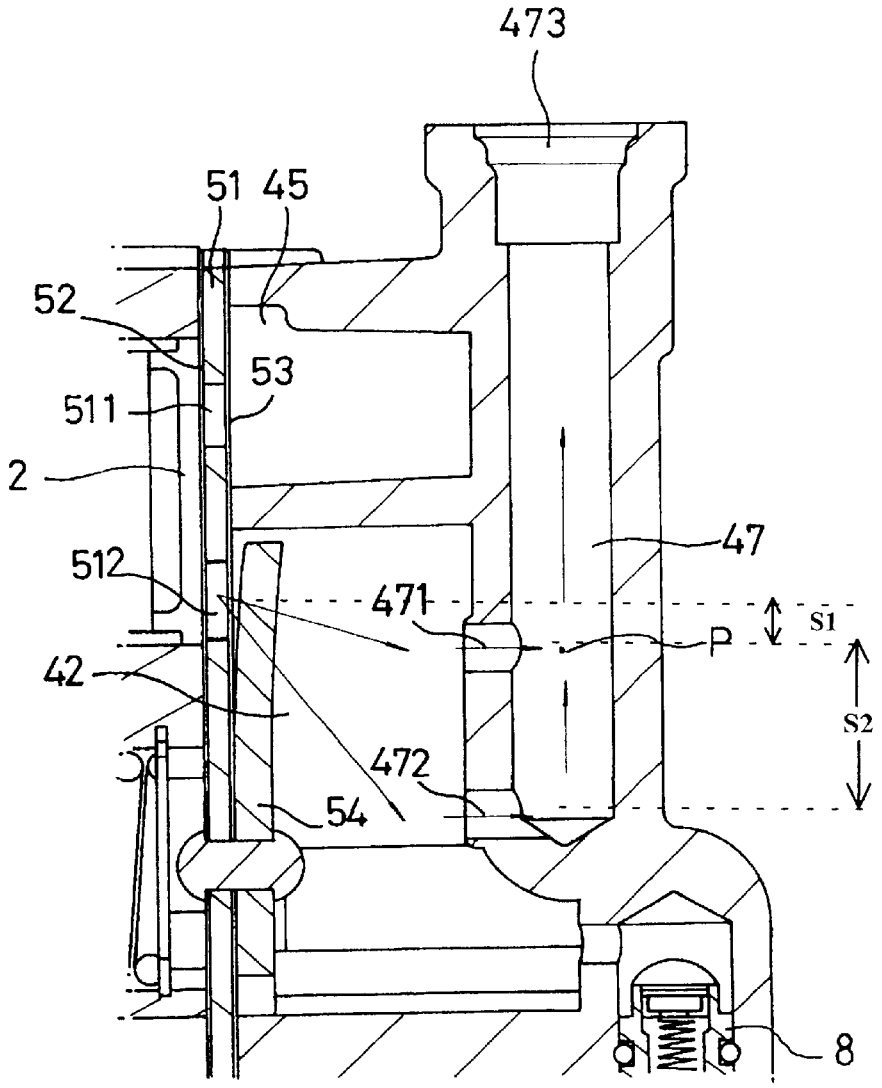
FIG. 3 is a partially enlarged side sectional view showing the discharge passage of the compressed refrigerant in the compressor in accordance with the present invention.

The rear housing 4 is a main characteristic part of the compressor of the present invention. As shown in FIGS. 1 to 3, the rear housing 4 is a die casting mold product, which is coupled to the rear side of the cylinder block 1 while being provided with the valve plate 51 therebetween. The rear housing 4 defines four independent spaces that are cut off from the bores 11 of the cylinder block 1 by means of the valve plate 51 behind the cylinder block 1. The four spaces are composed of a suction chamber 45 abutting on the outsides of the plurality of bores 11 of the cylinder block 1 at the same time, a suction pipe passage 48 communicating with the suction chamber 45 through a suction hole (not shown) and connected to a discharge pipe (not shown) of an evaporator at an inlet end 481 of the opposite side thereto, a discharge chamber 42 abutting on the plurality of bores 11 of the cylinder block 1 at the same time, and a discharge pipe passage 47 communicating with the discharge chamber 42 through at least two discharge holes 471 and 472 spaced at predetermined intervals and having a single outlet 473 to which an inlet pipe (not shown) of a condenser is coupled.

The valve plate 51, which is disposed between the cylinder block 1 and the rear housing 4, is a cut-off plate having a pair of suction and discharge holes 511 and 512 at the location corresponding to each bore 11 of the cylinder block 1, as illustrated in FIGS. 1 to 3. Thereby, the valve plate 51 cuts off the suction chamber 45 and the discharge chamber 42 of the rear housing 4 relative to each bore 11 of the cylinder block 1, in such a manner that it makes the space cut off communicate to the cylinder block 1 only through the suction hole 511 and the discharge hole 512.

On the front and rear surfaces of the valve plate 51, there are provided a suction reed valve 52 and a discharge reed valve 53 in an attached manner, each of which is a leaf type valve permitting the suction hole 511 and the discharge hole 512 to be opened only in one direction. The suction reed valve 52 permits the suction hole 511 to be opened only in the direction of the bore 11 of the cylinder block 1, and the discharge reed valve 53 permits the discharge hole 512 to be opened only in the direction of the discharge chamber 42 of the rear housing 4. On the rear surface of the discharge reed valve 53, there is attached a retainer 54 that prevents the discharge reed valve 53 from being opened excessively by substantially strong discharge pressure.

The driving shaft 6 is a power shaft that passes through the front housing 3, is inserted into the center of the cylinder block 1, as a front end thereof is passed through the center of the crank chamber 31, and is rotatably supported by the front housing 3 and the cylinder block 1. The driving shaft 6 is rotated by virtue of a pulley (not shown) fixedly attached thereon at the outside of the front housing 3.

The lug plate 61 is fixedly attached on the driving shaft 6 within the crank chamber 31 defined by the front housing 3 and is hinge-coupled to the one end of the swash plate 7 as will be discussed later at the one end thereof, with a consequence that the swash plate 7 is secured rotatably in the direction of the driving shaft 6. Thereby, the lug plate 61 rotates with the swash plate 7, by virtue of the driving shaft 6.

The swash plate 7 is a rotary part that is inserted slantly into the driving shaft 6 in the direction of the driving shaft 6 within the crank chamber 31 in such a manner as to be controlled in the inclination angle and is hinge-fixed on the lug plate 61 on the one end thereof. The swash plate 7 rotates by virtue of the lug plate 61, the outer periphery of which is swung in the direction of the driving shaft 6.

Each of the plurality of pistons 2 is inserted into each bore 11 of the cylinder block 1 on the head portion of the front end thereof and also inserted into the outer periphery of the swash plate 7 on the rear end portion thereof in such a manner that a swash plate receiving groove of a bridge 21 formed on the one side of the rear end portion of each piston 2 mounts a shoe. The swing of the swash plate 7 is produced forward and backward as the swash plate 7 rotates, such that each piston 2 is forced to move forward and backward within each bore 11 of the cylinder block 1, thereby generating positive and negative pressure in turn in the interior of each bore 11.

A reference numeral 8 denotes a pressure adjusting valve that is adapted to control the pressure in the crank chamber 31, based upon the relation between the pressure within the crank chamber 31 and the pressure within each bore 11, so that the inclination angle of the swash plate 7 is adjusted in accordance with cooling load. As a result, an amount of reciprocating movement of each piston 2 can be adjusted, thereby controlling compression capacity of the compressor.

All of the aforementioned parts are coupled and integrated by means of a bolt 13 that is inserted through the edge of the front housing 3 and thus fastened to the rear housing 4 via the cylinder block 1 and the valve plate 51. As the pulley (not shown) coupled to the driving shaft 6 is rotated by the power of the engine, the refrigerants at low pressure that have been thermally exchanged and evaporated in the evaporator (not shown) are sucked, compressed and discharged to the condenser (not shown) through the processes in the following order.

First, if the driving shaft 6 receives the rotary force of the pulley (not shown) on which the driving force of the engine is transmitted by the intermittent action of an electromagnetic clutch (not shown) through a disc and a hub assembling unit (which are not shown in the drawing) and rotates, the lug plate 61 fixedly attached on the driving shaft 6 rotates with the driving shaft 6, with a result that the swash plate 7 hinge-coupled on the one end of the lug plate 61 rotates with the lug plate 61. At this time, the swash plate 7 is swung in an axial direction on the outer periphery thereof because of a predetermined inclination angle relative to the driving shaft 6, such that each piston 2 with the bridge 21 inserted on the outer periphery of the swash plate 7 carries out a straight line reciprocating movement in each bore 11 of the cylinder block 1. In this process, during each piston 2 carries out a backward movement to the crank chamber 31 (that is, during a suction stroke), negative pressure is produced in the interior of each bore 11 of the cylinder block 1, such that the suction reed valve 52 is allowed to open the suction hole 511. Thereby, the refrigerants flow to the suction chamber 123 through the suction pipe passage 47 from the evaporator and are then sucked to each bore 11 through the suction hole 511 of the valve plate 411. At this time, if each piston 2 carries out a forward movement to the valve plate 51 (that is, a compression stroke), the refrigerants flowing to each bore 11 of the cylinder block 1 are compressed by the pressure of each piston 2, so that the discharge reed valve 53 is allowed to open the discharge hole 512, based upon the pressure in each bore 11 of the cylinder block 1. Thereby, the refrigerants at high pressure that have been compressed are discharged from each bore 11 of the cylinder block 1 to the discharge chamber 42 of the rear housing 4 through the discharge hole 512 of the valve plate 51 and then discharged through the discharge holes 471 and 472 of the discharge chamber 42 spaced from each other to the discharge pipe passage. Subsequent to this, the refrigerants move to the condenser. The discharging of the refrigerants is carried out by the straight line reciprocating movement of the pistons 2 that are carried out periodically with a predetermined time difference, such that the process where the refrigerants are discharged from the cylinder bore 11 via the discharge chamber 42 and the discharge pipe passage 47 necessarily accompanies a pulsation pressure having the same period as a refrigerant discharge period where refrigerant flows are carried out by means of each piston 2. Undesirably, at this time, the noise caused by the pulsation pressure at the time of driving is made.

According to the present invention, however, as shown in FIG. 3 the refrigerants discharged to the discharge chamber 42 through the discharge hole 512 of the valve plate 51 from each bore 11 after compressed by each piston 2 are distributed and discharged to the discharge pipe passage 47 through the structure of reducing the pulsation pressure where the at least two discharge holes 471 and 472 are spaced at different distances from the discharge hole 512, such that the pulsation pressure the refrigerants discharged to the discharge pipe passage 47 through each of the discharge holes 471 and 472 have can be considerably lowered. At this time, the frequency of the pulsation pressure is increased in proportion to the number of the discharge holes 471 and 472 coupling the discharge chamber 42 and the discharge pipe passage 47, but the pulsation pressure itself is greatly decreased, with a result that the driving noise produced in proportion to the strength of the pulsation pressure can be substantially reduced.

Particularly, if the at least two discharge holes 471 and 472 are placed in such a manner that the refrigerant flows discharged from the at least two discharge holes 471 and 472 are met at the discharge pipe passage 47, while having a predetermined phase difference (preferably, the phase difference corresponding to ½) relative to the period of the pulsation pressure, an increase of the pulsation pressure according to a beat phenomenon caused at the time of the meeting of the two refrigerant flows can be suppressed, with a result that the driving noise of the compressor will be reduced in an effective manner.

As shown in FIG. 3, by way of example, the two discharge holes 471 and 472, that is, the first and second discharge holes, are placed on the discharge chamber 42, and when it is assumed that the flow speed of the refrigerants discharged from each of the first and second discharge holes 471 and 472 is V (m/sec) and the period of the pulsation pressure the flow has is T (sec), if the location of the first discharge hole 471 is set in such a manner that a distance S1 from the discharge hole 512 of the valve plate 51 to a point P within the discharge pipe 47 where the two flows are met to each other via the first discharge hole 471 is aVT (m) (where a represents an integral number and VT represents the moving distance per a period), the location of the second discharge hole 472 should be set in such a manner that a distance S2 from the discharge hole 512 of the valve plate 51 to the point P via the second discharge hole 472 is $bVT\times\alpha$ (where b represents an integral number and $\alpha<VT$). That is to say, the first and second discharge holes 471 and 472 should be located in such a manner that the refrigerant flows discharged from each of the first and second discharge holes 471 and 472 are met to each other at the point P while the periods of the pulsation pressure the refrigerant flows have cross each other, such that an increase of the pulsation pressure according to a beat phenomenon of each flow can be supressed, thereby enabling the driving noise of the compressor to be substantially reduced.

On the other hand, the velocity of the refrigerant flow V as the variant considered when the locations for the first and second discharge holes 471 and 472 are set to have the phase difference of the pulsation pressure is affected by numerous factors such as, for example, the properties (compression and viscosity) of the refrigerants, the shapes of the discharge hole 512, the retainer 54, the discharge chamber 42 and the discharge pipe passage 47 guiding the refrigerants, and the sizes and discharge pressure of the first and second discharge holes 471 and 472, thereby making it impossible to obtain a theoretically calculated value thereof. It is, therefore, desirable that the number of the discharge holes, the sizes thereof and the locations thereof are set, based upon trial and error results through practical tests for the compressor.

Figure 4:
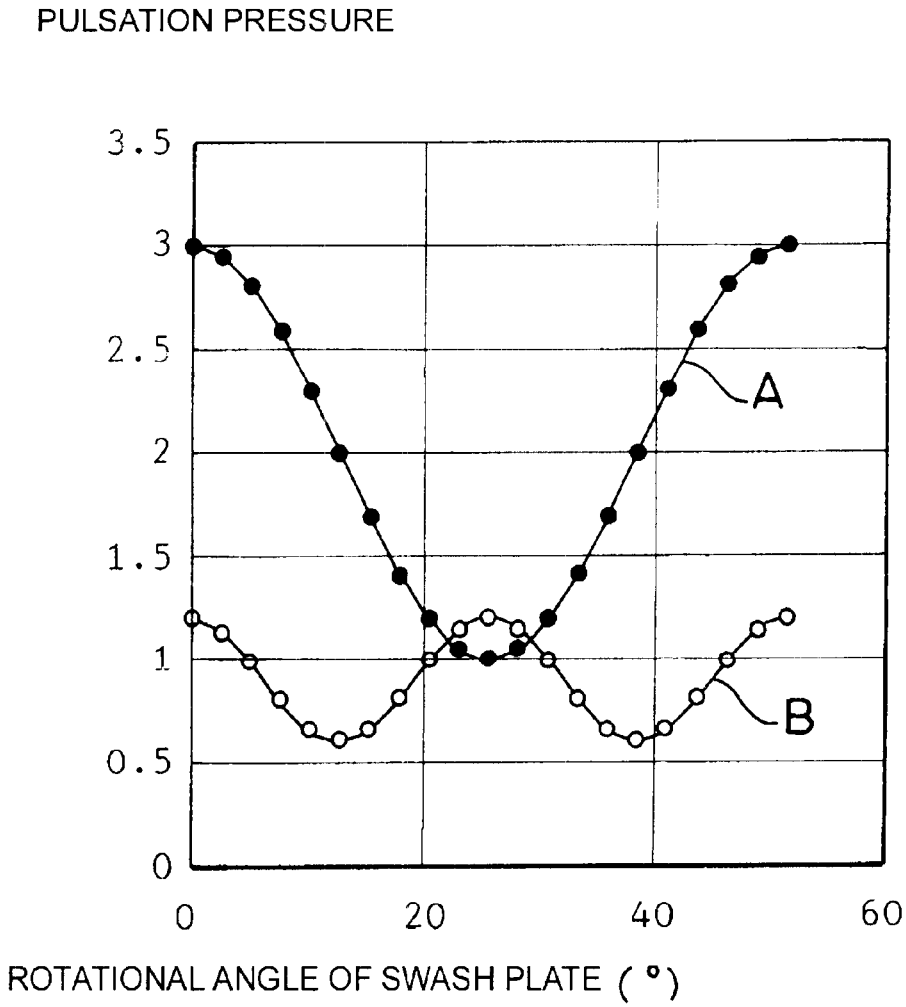
FIG. 4 is a graph representing the characteristics of the pulsation pressure in the two flows of the discharged refrigerant in the compressor in accordance with the present invention.
Figure 5:
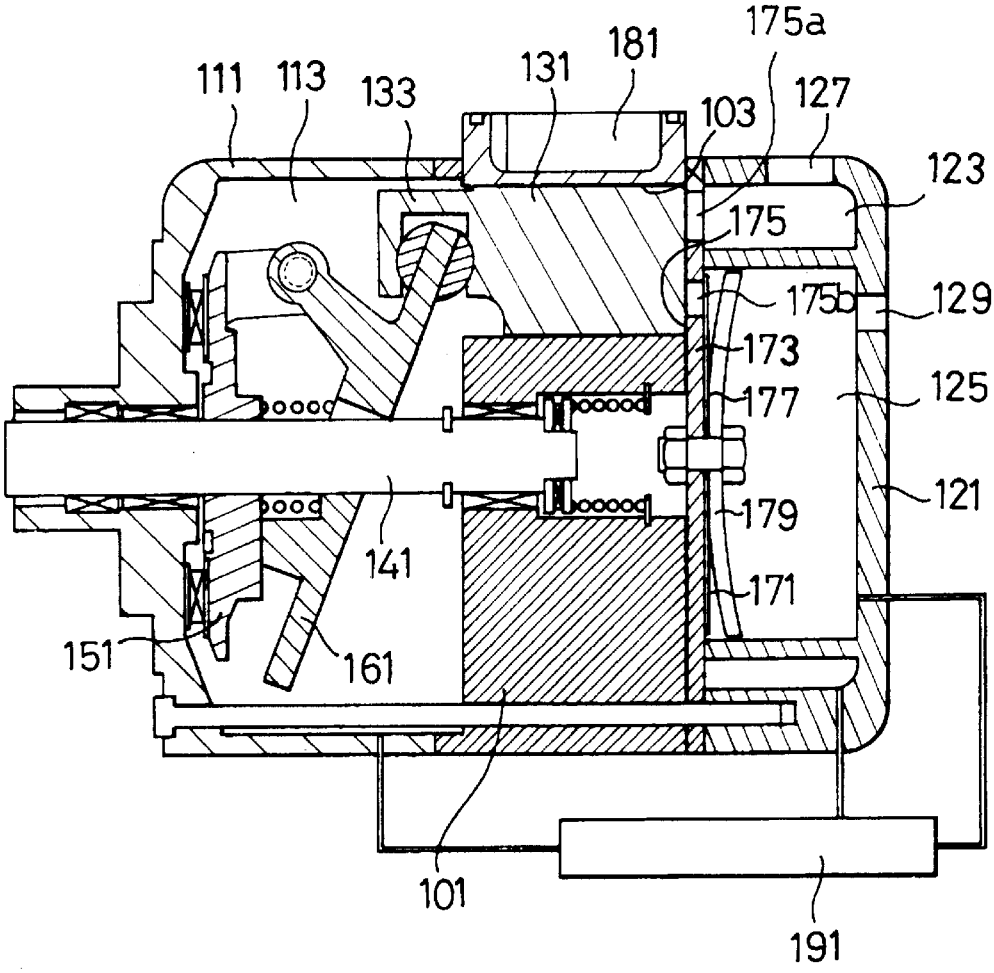
FIG. 5 is a sectional view of a conventional compressor.

FIG. 4 illustrates a graph of the characteristics of the pulsation pressure in the two refrigerant flows discharged in the compressor according to the present invention, wherein the periods of the pulsation pressure of the refrigerants discharged from the discharge holes 471 and 472 cross each other.

This graph shows the pulsation pressure characteristics of the refrigerant flows at a predetermined point at the time when the refrigerants discharged to the discharge chamber in accordance with the compression of the pistons 2 in the compressor having 7 pistons 2 are distributed and discharged through the first and second discharge holes 471 and 472 and thus the periods of the pulsation pressure of the refrigerants discharged from the first and second discharge holes 471 and 472 are met to each other at the state where they completely cross each other. A cycle A represents the pulsation pressure characteristics of the refrigerant flow of the first discharge hole 471, and a cycle B represents the pulsation pressure characteristics of the refrigerant flow at the outlet 481 of the discharge pipe passage 47 that mean the results to appear at the time when the two refrigerant flows discharged via the first and second discharge holes 471 and 472 to the discharge pipe passage 47 are met to each other.

As appreciated from the graph, the two refrigerant flows met at the discharge pipe passage 47 through the first and second discharge holes 471 and 472 represent substantially low pulsation pressure. With the compressor of the present invention having N pistons 2, in case of the provision of the two discharge holes 471 and 472 in the discharge chamber 42 of the rear housing 4, the refrigerants are discharged with the refrigerant flow having 2N pressure wave motions through the outlet of the discharge pipe passage 48 but discharged in the state where the pulsation pressure is considerably reduced in inverse proportion to the number of the discharge holes when compared with the compressor having a single discharge hole, such that the driving noise produced in proportion to the strength of the pulsation pressure can be remarkably reduced.

Furthermore, the structure where the pulsation pressure of the refrigerant discharged is reduced may be applicable to a structure where the pulsation pressure of the refrigerant sucked is reduced.

For instance, if a plurality of suction holes (not shown) are provided between the suction chamber 45 and the suction pipe passage 48, the refrigerants flowing to the bores 11 via the suction chamber 45 from the evaporator have different phases and are thus distributed to the bores 11 in the plurality of flows each having considerably reduced pulsation pressure. As a result, the pulsation pressure according to the suction of the refrigerants is reduced, thereby enabling the driving noise of the compressor to be further reduced.

As clearly discussed in the above, a compressor with a pulsation pressure reducing structure according to the present invention can embody the structure by distributing and discharging the refrigerant that has been compressed by a plurality of pistons and discharged from to a plurality of bores into at least two discharge holes, wherein a frequency of the pulsation pressure is increased in proportion to the number of the discharge holes but a strength of the pulsation pressure is decreased in inverse proportion to the number of the discharge holes. Therefore, a driving noise of the compressor that is produced in proportion to the strength of the pulsation pressure is considerably decreased. Moreover, if the at least two discharge holes are placed in such a manner that the refrigerant flows discharged from the at least two discharge holes are met at the discharge pipe passage while having the phase difference corresponding to a half of the period of the pulsation pressure, an increase of the pulsation pressure according to a beat phenomenon caused at the time of the two refrigerant flows meeting can be minimized, thereby reducing the driving noise of the compressor in an effective manner.

The forgoing embodiments are merely exemplary and are not to be construed as limiting the present invention. The present invention can be readily applied to other types of apparatuses. The description of the present invention is intended to be illustrative, and not to limit the scope of the claims. Many alternatives, modifications, and variations will be apparent to those skilled in the art.

What is claimed is:

1. A compressor with a pulsation pressure reducing structure, comprising:

a cylinder block provided with a plurality of bores radially arranged for a plurality of pistons to be movably inserted therein;

a front housing positioned in front of said cylinder block to define a crank chamber that communicates with the bores of said cylinder block;

a rear housing positioned in the rear side of said cylinder block;

a valve plate positioned between said cylinder block and said rear housing, said valve plate having a plurality of suction holes and discharge holes whose respective number is same as that of said bores;

a suction reed valve positioned in front of said valve plate for opening said suction holes;

a discharge reed valve positioned in the rear side of said valve plate for opening said discharge holes;

wherein, said rear housing providing a suction chamber and a discharge chamber that communicate with said plurality of bores through said plurality of suction holes and said plurality of discharge holes in such a manner to be separated from each other, on the rear side of said cylinder block, and providing a suction pipe passage that communicates with said suction chamber and a discharge pipe passage that communicates with said discharge chamber through at least two discharge holes separated from each other relative to said plurality of discharge holes of said valve plate;

a driving shaft adapted to be extended through said front housing in such a manner as to be disposed on the center of said crank chamber in a longitudinal direction of said cylinder block and supported by means of said front housing;

a lug plate adapted to be fixedly attached around said driving shaft of said crank chamber and rotated by said driving shaft;

a swash plate adapted to be slantly fitted around said driving shaft and hingedly attached to said lug plate to be rotated together by said lug plate; and a plurality of pistons adapted to be engaged with the outer periphery of said swash plate to perform reciprocating movement within the bores of said cylinder block by wobbling of an outer periphery of said swash plate in the forward and backward directions according to the rotation of said driving shaft.

2. The compressor according to claim 1, wherein said at least two discharge holes connecting said discharge chamber to said discharge pipe passage in said rear housing are spaced apart from each other so that refrigerant flows, which are discharged from said discharge chamber through said at least two discharge holes to said discharge pipe passage while having a pulsation pressure of the same period, by an interval to allow the refrigerant flows to have a phase difference at a position where said two refrigerant flows meet.

3. The compressor according to claim 2, wherein said phase difference between pulsation pressures of two refrigerant flows is a half of a period of the pulsation pressures.

4. The compressor according to claim 1, wherein said suction holes connecting said suction pipe passage to said suction chamber in said rear housing are at least two in number, and spaced from an inlet of said suction pipe passage by different distances.

* * * * *